United States Patent [19]

Angst et al.

[11] Patent Number: 4,732,501

[45] Date of Patent: Mar. 22, 1988

[54] METHOD AND APPARATUS FOR LOADING OF A WEB INTO A PRINTER

[75] Inventors: Tim V. Angst, Charlotte; Joel G. Goodwin, Concord, both of N.C.

[73] Assignee: International Business Machines Corporation, Armonk, N.Y.

[21] Appl. No.: 852,187

[22] Filed: Apr. 15, 1986

[51] Int. Cl.[4] ..... B41J 11/28

[52] U.S. Cl. ..... 400/616.3; 400/583.4; 400/605; 400/636; 400/708; 400/902

[58] Field of Search ..... 400/583.4, 605, 613.1, 400/616.3, 636, 708, 708.1, 902; 226/91, 92; 156/521

[56] References Cited

U.S. PATENT DOCUMENTS

| | | | |
|---|---|---|---|
| 3,315,860 | 4/1967 | Adams et al. | 400/616.3 X |
| 3,334,722 | 8/1967 | Bernard | 400/613.1 X |
| 3,598,219 | 8/1971 | Stevenage et al. | 400/583.4 X |
| 3,722,655 | 3/1973 | Singer | 400/613.1 |
| 4,090,410 | 5/1978 | Nakamura | 400/636 X |
| 4,111,565 | 9/1978 | Jagger | 400/708 |
| 4,124,435 | 11/1978 | Stump et al. | 156/521 |
| 4,164,376 | 8/1979 | Yarp | 400/605 X |
| 4,417,825 | 11/1983 | Cushman et al. | 400/605 |
| 4,452,543 | 6/1984 | Adkisson et al. | 400/605 |
| 4,569,610 | 2/1986 | Drejza et al. | 400/636 |
| 4,606,663 | 8/1986 | Christoph et al. | 400/605 |
| 4,619,388 | 10/1986 | Ono et al. | 400/605 X |

FOREIGN PATENT DOCUMENTS

| | | | |
|---|---|---|---|
| 0061635 | 10/1982 | European Pat. Off. | 400/616.3 |
| 0073578 | 3/1983 | European Pat. Off. | 400/616.3 |
| 2556583 | 6/1976 | Fed. Rep. of Germany | 400/616.3 |
| 0187282 | 11/1982 | Japan | 400/605 |

*Primary Examiner*—Ernest T. Wright, Jr.

*Attorney, Agent, or Firm*—Bell, Seltzer, Park & Gibson

[57] ABSTRACT

A method and apparatus for loading a web into a printer is disclosed. The apparatus has a normal mode for moving the web in normal operation and a load assist mode for operating at a slower than normal rate for loading the web into the printer. The printer comprises means for recording information on the web including a platen attached to the printer and a print head for generating characters. The print head is disposed in a predetermined spaced relationship from the platen to define a print station therebetween. A means for engaging and moving the web through the print station and signal means for generating normal and load assist mode signals are provided. Means for driving the means for engaging and moving the web is responsive to the normal mode signal from the signal means for operating during normal printing operation and responsive to the load assist mode signal from the signal means for operating at a slower than normal rate to facilitate alignment and engagement of the web with the means for engaging and moving the web during web loading operations.

26 Claims, 4 Drawing Figures

METHOD AND APPARATUS FOR LOADING OF A WEB INTO A PRINTER

FIELD OF THE INVENTION

This invention relates generally to the field of computer printers or plotters, and more particularly to a printer having a normal mode for moving the web in normal operation and a load assist mode for operating at a slower than normal rate for loading the web into the printer.

BACKGROUND AND SUMMARY OF THE INVENTION

Currently available computer printers are adapted to print on a variety of mediums, and each medium may have a variety of formats. The medium is most commonly paper, but it may also be plastic, or some other material. The format may be lengthy continuous forms or discrete items such as cut sheets or envelopes. Regardless of the medium or format, they are referred to as webs in this application. Some or all of these webs may include edge perforations compatible with pin wheel or tractor type drives. Alternatively, these perforations may be omitted, provided the printer has some other means for engaging and moving the web, such as rollers.

Each printer usually structurally defines a path along which the web is transported as it progresses past the print head or other means for printing upon the web. Alignment of the web in this path is critical to proper operation of the printer, from both the mechanical standpoint of starting, moving, and stopping the web, and the aesthetic standpoint of properly orienting and aligning the printed information on the web. Improper alignment usually results in jamming of the means for moving the web, tearing or otherwise destroying the web, ripping or decoupling the edge perforations from the web, undesirably wrinkling the web, which may even damage the ribbon, platen, print head, or other parts of the printer. In addition to the resulting damage to the web or printer, there is down time resulting in a loss of productivity, and the necessity of reprinting all of the information.

This problem of keeping the web aligned in the web path is aggravated by the cumbersome problem of trying to properly align the delicate web with the printer during web loading operations. Unless the approach angle of the web to the printer is exactly zero degrees, any error in alignment will compound itself as the web is moved through the printer. It makes no difference whether the web is short (i.e. a cut form or envelope) or long (i.e. a continuous fan-folded web), any misalignment can be fatal to proper advance of the web and operation of the printer.

In the past, when loading a web into a printer, both hands of the operator were needed to grasp the opposite sides of the web, hold it taut, align it, and position it so that it could be gripped by the web advance means for feeding through the printer. However, with both of the operator's hands occupied holding the web, there was no convenient way to slow or manually operate the web advance means and ensure proper alignment during loading. For instance, while the web advance means was deactivated, the operator had to engage the web with the web advance means by either manually turning a web advance knob or by hand guiding the paper through the paper path. In knob type manual loading, the operator needed to grasp opposite sides of the web, hold it taut, align and position it with respect to the web moving means, and then turn the web advance knob. A problem encountered in the prior art was coordinating all the various steps with one hand while turning the web advance knob with the other hand. In the hand guide method of the prior art, first the operator had to release and disengage the web advance means to provide an unobstructed access for the web, then the web had to be hand guided into the paper path and pushed through until it came into position between the ribbon and platen. The operator then had to align and position the web and engage the web advance means without disturbing the web. A problem of this method was that the web would tend to fall out of position and alignment when the operator's hand was removed from the web to engage and close the web moving means. The magnitude of these problems increased with increases in the length and width of the web, and higher web advance speeds.

This problem has been addressed in the past, but solutions have required the use of auxiliary feeding apparatus that is external to the printer, and that must be manually positioned and operated. (See U.S. Pat. No. 3,722,655 to Singer). Other proposed solutions involved stopping the machine and physically changing the gears to slow the speed of web movement or to resume normal operating speed. (See U.S. Pat. No. 4,124,435 to Stump et al.)

In view of the foregoing, it is an object of the present invention to provide a method and apparatus for loading a web into a printer.

It is a further object of the present invention to provide a printer having a web moving apparatus with a first web advance mode for normal operation and a second web advance mode for loading the web into the printer.

It is a further object of the present invention to provide a method and apparatus to facilitate loading a web into a printer and advancing the edge of the web to a predetermined position.

It is a further object of the present invention to provide a method and apparatus for loading a web into a printer which frees the hands of the operator for proper positioning of the web in the printer while operating the web engaging and moving apparatus at a slower than normal rate.

It is a further object of the present invention to provide a method and apparatus for loading a web into a printer which uses existing printer components and does not require external apparatus.

It is a still further object of the present invention to provide a method and apparatus for loading a web into a printer with only minor modification or adjustment of the printer.

These and other objects are accomplished by generally providing a method and apparatus for loading a web into a printer. The printer comprises means for recording information on a web, which defines a print station. Further included is means for engaging and moving the web through the print station, and signal means for generating a normal mode signal and a load assist mode signal. A means for driving the means for engaging and moving the web is responsive to the normal mode signal from the signal means for operating the printer at a normal rate, and responsive to the load assist mode signal from the signal means for operating the printer at a slower than normal rate. The slower rate is used during web loading operations and facilitates alignment and engagement of the web with the means for engaging and moving the web.

DESCRIPTION OF THE ILLUSTRATED EMBODIMENT

While the present invention will be described more fully hereinafter with reference to the accompanying drawings in which a particular embodiment is shown, it is to be understood at the outset that a person skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
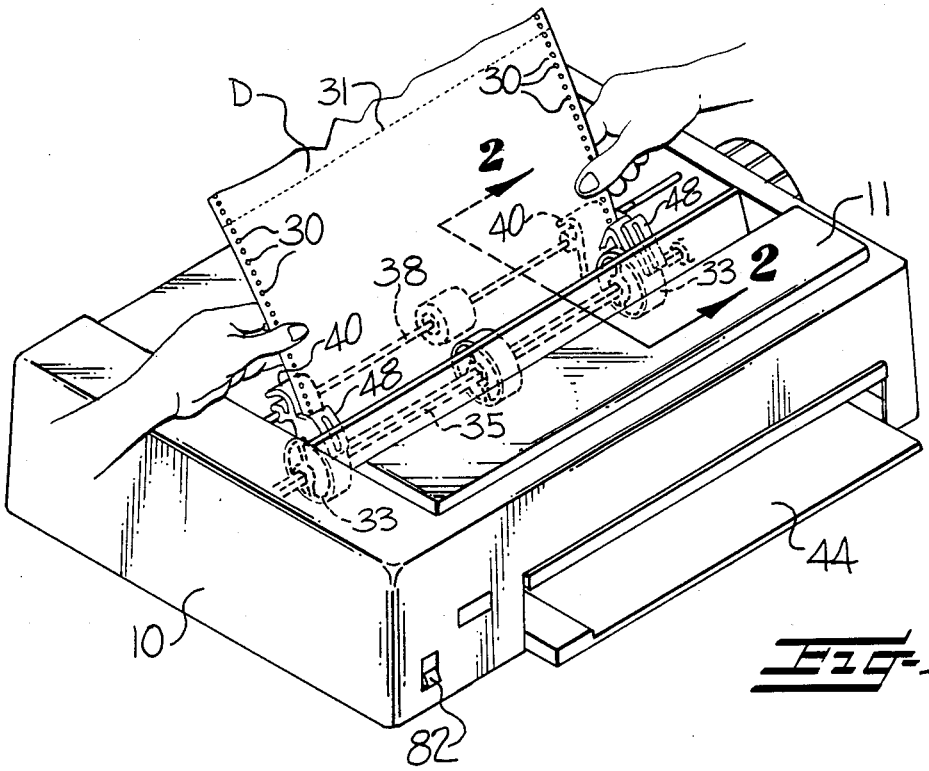
FIG. 1 is an isometric view of the printer, illustrating how both hands are required to load a continuous form into the printer.

Referring to FIG. 1 the apparatus for assisting in the loading of a web into a printer is illustrated in association with a printer of the type commonly used in computer or data processing applications. The printer includes an outer housing 10 with a removable access cover 11 supported on the upper surface of the housing 10 to provide access to the web guiding and printing mechanism supported beneath the cover 11. The present invention is illustrated with a printer which includes multiple web or document feed paths and these are disclosed in detail in commonly owned U.S. Pat. No. 4,569,610 for a Multifunction Document Transport System For Printers, which is incorporated herein by reference. Only so much of the printer frame assembly is illustrated in the present disclosure as is necessary for an understanding of the present invention.

Figure 3:
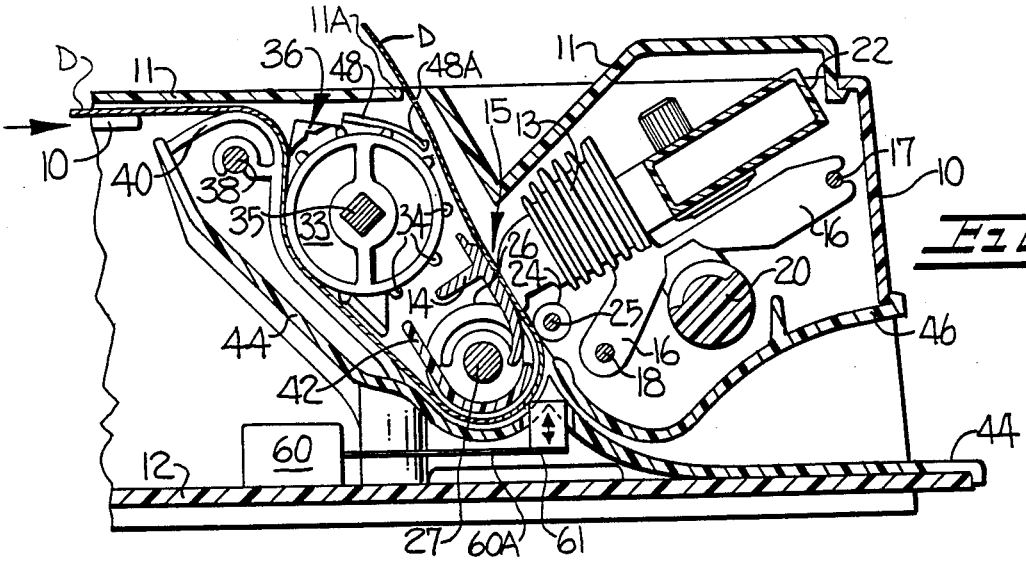
FIG. 3 is a vertical fragmentary sectional view taken substantially along line 2—2 in FIG. 1 and illustrating the signal means actuated by a continuous web in a first feeding path.
Figure 4:
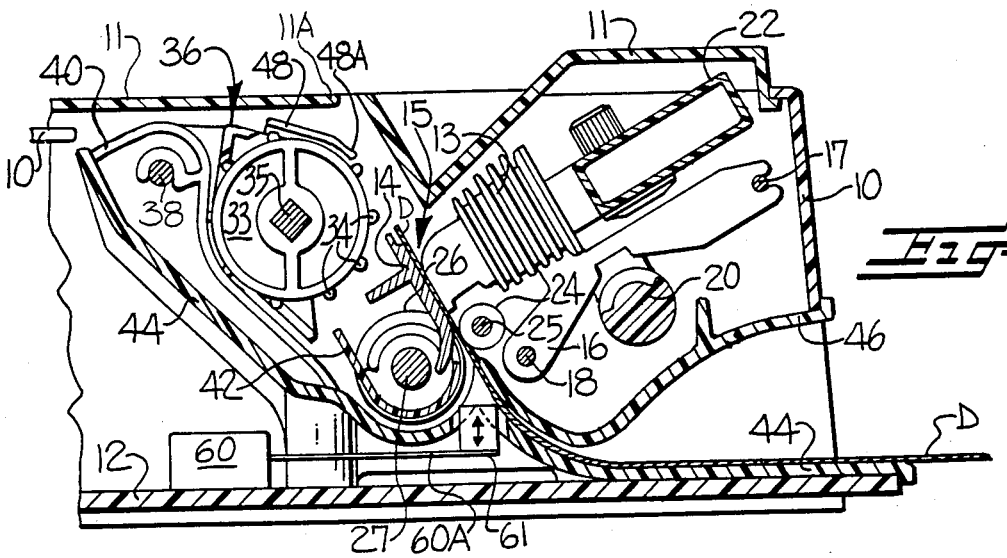
FIG. 4 is a view similar to FIG. 3 and illustrating the signal means actuated by a cut form web in a second feeding path.

Referring to FIGS. 3 and 4, and using the same reference numeral to identify the same item, the printer is supported on a base 12 and includes a reciprocating print head 13, illustrated here as a wire matrix print head for recording data on a web D. A platen 14 extends across the width of the printer and its opposite ends are supported in a conventional manner by end frames or the like (not shown) with the forward portion of the platen 14 being in a spaced right-angular alignment with the print head 13 to define a print station 15 therebetween.

Figure 2:
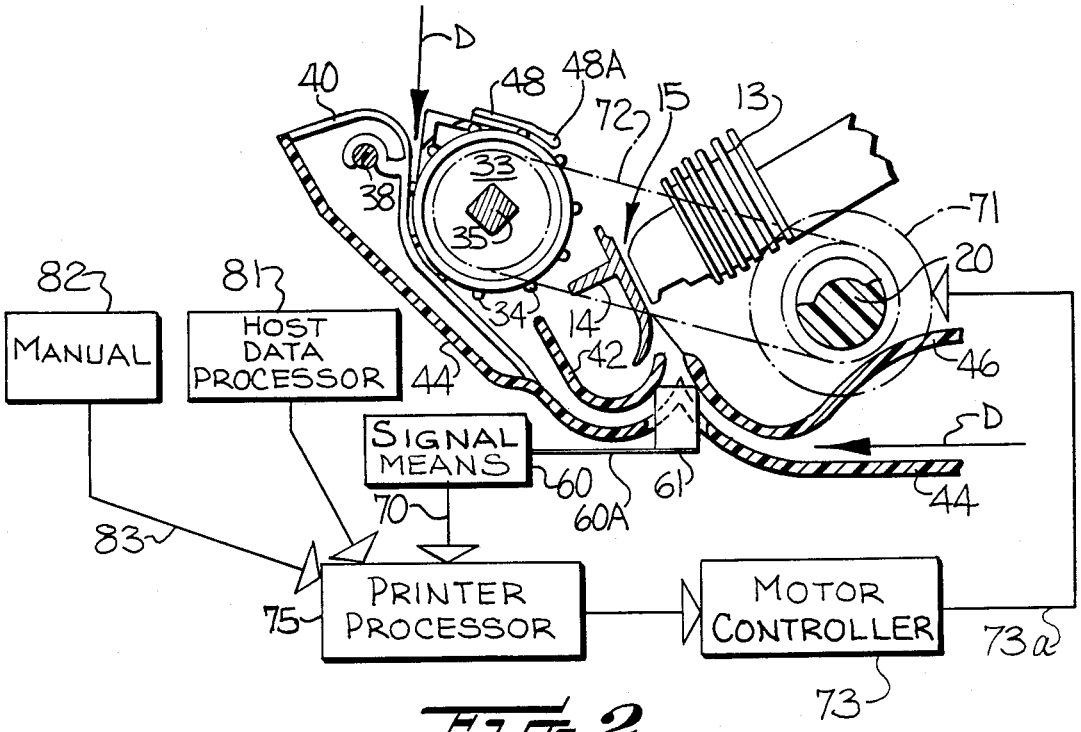
FIG. 2 is a schematic illustration of a typical printer, in cross-section, taken along line 2—2 of FIG. 1, showing the means for detecting the presence of a web and the means responsive thereto for controlling a stepping motor which advances the web to the proper position for printing.

Print head 13 is supported for transverse movement back and forth across the width of the printer on a guide bracket 16 that is supported at its forward and rearward ends on guide rods 17, 18. The guide bracket 16 is moved back and forth across the width of the printer by worm-type screw 20 which is driven by a suitable stepping motor 71 (FIG. 2). A ribbon cartridge 22 is removably supported above the guide bracket 16 for feeding a ribbon between the print head 13 and the web D at the print station 15 to form the printed indicia on the web D when the ribbon is engaged by the individual print wires in the print head 13. Other types of moving and stationary print heads, and associated drives, platens and ribbons, may be substituted as necessary or desirable. For example, the printing may be done electrostatically, thermally, or by engraved type or ink jet.

Means for engaging and moving the web D through the print station 15 are provided in the form of friction roll driving means and pin wheel driving means, both of which are positioned upstream of the print station 15 for advancing the web D therethrough. Although there are two separate means for driving the web D, together they comprise a single web moving apparatus. The friction roll driving means includes a plurality of friction roll segments 24 of a relatively small diameter supported on and driven by a drive shaft 25. The friction roll segments 24 are spaced across the width of the printer and supported immediately below the path of back and forth movement of the print head 13 so that the surface of the friction roll segments 24 engage the face of the web D immediately prior to the print station 15 defined in part by the print head 13. Friction roll segments 26 extend the width of the printer and engage the opposite face of the web D, in parallel alignment with the friction roll segments 24. The friction roll segments 26 are larger in diameter than the friction roll segments 24 and are supported on and driven by a drive shaft 27 which is drivingly connected by suitable gears, not shown, to friction roll drive shaft 25. Documents are guided, in a manner to be described, into the nip between the small friction drive roll segments 24 and the large friction drive roll segments 26 and are fed thereby through the print station 15 and between the print head 13 and the platen 14. The friction roll segments 24 are about one-half the size of the friction roll segments 26 so that the friction roll segments 24 can be positioned closely beneath the path of travel of the print head 13. It will be noted that the document feeding nip of the friction drive rolls or roll segments 24, 26 is positioned immediately in advance of the print line, preferably within about one-half inch, so that the positive control of the document is maintained at a point immediately adjacent and in advance or upstream of the print line. This arrangement permits printing on webs such as cut form documents within about one-half inch of the leading and trailing edge of the documents.

Pin wheel driving means is positioned in advance or upstream of the friction roll driving means for advancing a web such as a continuous web type form, indicated at D. The continuous web document D has uniformly spaced pin feed holes 30 along its outer edge portions and transversely extending perforated tear lines 31 in spaced apart relationship along the length of the continuous web document D. The pin wheel driving means includes a pair of spaced apart pin wheels 33, as shown in FIG. 1. Each pin wheel 33 includes uniformly spaced outwardly projecting pins 34 around its perimeter. The pin wheels 33 are supported for lateral adjustment along and on a square drive shaft 35 by corresponding support assemblies, broadly indicated at 36 (FIGS. 3–4). This support assembly 36 is maintained in an adjusted position on the drive shaft 35 and a guide support shaft 38 (FIG 1). The drive shaft 35 for the pin wheels 33 is drivingly connected through suitable gearing, not shown, to drive shafts 25, 27 supporting the friction drive roll segments 24, 26. The drive shafts 25, 27 are rotated so that the surfaces of the roll segments 24, 26 move at a slightly faster speed than the surface of the pin wheels 33. This maintains tension on the continuous web document D between the pin wheels 33 and the roll segments 24, 26 and also maintains the document D in firm engagement with the lower surface of the roll segment 26 as it passes beneath the same. The tension aids in maintaining web alignment.

The printer with which the present invention is illustrated includes multiple feed paths for the feeding of a continuous web document D as indicated in FIG. 3, or for the feeding of an individual cut form web D, as indicated in FIG. 4. Webs D can be fed through the printer to the print station 15 along any one or more of different paths, as illustrated in FIGS. 3–4. Referring to FIG. 3, the web D is initially guided by the front of guide plate 40 to bring the pin feed holes 30 of the web D into engagement with the pins 34 of pin wheels 33. Guide plate 42, downstream from the pin wheels 33, and lower guide plate 44 funnel together and define a guide passageway that directs the web D into contact with the lower portion of roller 26 and into the nip of roller or roll segments 24, 26. Referring to FIG. 4, the rightmost portion of lower guide 44 and upper front guide plate 46 converge to define another web path that extends transversely across the front of the printer, forming a wide opening or "mouth" on the front panel of the housing 10 (FIG. 1) to conveniently accommodate a cut sheet or envelope. These web paths join and merge into a single path immediately upstream of the nip of roller or roll segments 24, 26. Thus, documents D can be fed into the printer to the print station 15 along multiple feed paths, or a combination of feed paths, and the invention is equally applicable to all.

After passing through the print station 15, the web D exits the printer. Referring to FIG. 3, the web D is directed by the leading edge 48A of guide 48 and the end portion 11A of cover 11 to avoid the pins 34 on the pin wheels 33 and exit at the top of the printer.

Referring to FIGS. 2–4, signal means 60 generates first and second signals in response to the presence or absence of a web D at a signal station 61. The signal means 60 thus acts as a sensor for generating paper-in and paper-out signals. The signal station 61 is positioned proximate the confluence of the incoming web feed paths for detecting the presence or absence of a web D in any of the feed paths at that location. The signal means 60 generates a first signal when a web D is present in one or more of the feed paths at the signal station 61, and a second signal when a web D is absent at the signal station 61. Similarly, the signal means 60 changes state as the edge of a web D is presented to, or passes by, the signal station 61. In the embodiment of FIGS. 2–4, the signal means 60 takes the form of a microswitch 60, with a sensor arm 60A having an end that extends into the path of web travel, forming the signal station 61. The signal station 61 is preferably positioned upstream of the print station 15 and may further function as a "paper out" signal to the operator by monitoring the presence or absence of a web D in any of the web feeding paths. Referring to FIGS. 1 and 2, the printer processor 75 may also be actuated manually by means of a switch 82 located on the control panel of the printer. The signal means 60 and signal station 61 may also comprise alternate means, such as optical or electronic sensors, and their location may be changed, as will be evident from this disclosure.

Referring to FIG. 2, means for driving the means for engaging and moving the web D includes a stepping motor 71 which is connected by a suitable belt 72 or gearing (not shown) to pin wheel shaft 35 and to friction roll shafts 25, 27 (omitted for clarity) to drive them in unison as disclosed earlier. The starting, stopping and speed of stepping motor 71 is controlled by a motor controller 73 through line **73*a*. The motor controller 73 responds to signals from the printer processor 75, which samples and logically interprets any command and data signals from a host data processor 81, the signal means 60, manual switches 82 on the printer, or any other source. These elements, plus any other that may be necessary or desirable, together comprise the means for driving the means for engaging and moving the web D. Assuming that the stepper or stepping motor 71 and means for engaging and moving the web D are to operate in only two modes, motor controller 73 outputs to the stepping motor 71 either a first set of signals for normal mode operation or a second set of signals for operation at a slower than normal rate, such as for loading the web D into the printer. The desired output may be provided in response to a signal from the signal means 60 on line 70, a time delay, or a combination of the two. Thus, the motor controller 73 typically outputs a higher number of pulses per unit time for normal mode operation and a lower number of pulses per unit time for slower mode operation. Although movement with the stepper or stepping motor 71** may be a set of discrete steps spaced by microsecond delays, the effect is to move the web D at a slower than normal rate. If the means for driving is a DC motor, the first and second sets of signals would be at different voltage levels to achieve different rates or speeds of operation. The use of other motive systems and controllers is also acceptable.

In operation, it is desired that means for engaging and moving the web D through the print station 15 operate at a slower constant speed while the operator aligns the web D with the web moving apparatus, and then return to normal operation after loading is finished. Different examples are discussed for each of FIGS. 2–4.

Referring to FIGS. 2 and 3, assume initially that no web D is present in the printer. The pin wheels 33, nipping rolls or roll segments 24, 26, and associated stepper or stepping motor 71 are stopped. The signal station 61 detects the absence of a web D and the associated signal means 60 responds by generating a second (paper-out) signal on line 70 to a printer processor 75 and motor controller 73. As noted earlier, the printer processor 75 accepts inputs from the manual switch 82 and host data processor 81. To load the web D in a load assist mode of operation, the operator manually presses button 82, which generates a load assist signal on line 83. The printer processor 75, responding to the load assist signal on line 83 and the second (paper-out) signal on line 70, provides signals to the motor controller 73 to operate the stepper motor 71 at a slow constant rate so that pin wheel 33 also turns at a slow constant rate, such as a rate significantly less than the normal rate of three inches per second. The operator grasps the edges of the web D, aligns it with guide 40, and trains the pin feed holes 30 over the pins 34 of the pin wheels 33. As the web D is slowly advanced along guide 40, it encounters web guide 44 and is directed to signal station 61. Upon detection of the edge of the web D thereat, the signal means 60 transitions from a second (paper-out) signal to a first (paper-in) signal. The combination of the signal means 60, printer processor 75 and motor controller 73 continue to advance the web D for a predetermined time, or distance, until the edge of the web D has advanced through the print head 13 and platen 14 and the web D has exited the printer housing 10. The means for moving the web D may then stop the web D, or it may continue operation while the print head 13 begins printing. In any event, web advance may now be in the normal mode of operation.

In alternative modes, the slower web advance speed may continue until the edge of the web D is detected at the signal station 61, with the web D then being advanced at the normal or full speed through the rollers or roller segments 24, 26 to a predetermined position. Or, the slower web advance speed may continue until the button 82 is depressed a second time.

Referring to FIGS. 2 and 4, the invention may also be used with the front feed path for cut sheet webs D, such as single sheets or envelopes. Assuming the same initial conditions noted for FIG. 3, the cut web D is directed through the feed path defined by lower guide plate 44 and upper front guide plate 46. As the envelope or cut web D is advanced through the mouth in the front panel of the printer, the leading edge thereof contacts the signal station 61. Upon detection of the edge of the web D thereat, the signal means 60 transitions from a second signal to a first signal. The combination of the signal means 60, printer processor 75 and motor controller 73 operate the stepping motor 71 at the slower constant speed to advance the leading edge of the web D through the nip of the friction rolls or roll segments 24, 25 with the first print line in position on the platen 14 for printing, or with the edge at a position beyond the platen 14, as illustrated. The front feed path may also be used for edge perforated forms where the web D exits as shown in FIG. 3.

The present invention may also be employed when feeding more than one type of web D through the printer. For example, a continuous web D may be loaded into the printer as described in connection with FIG. 3. It may then be desired to interrupt the printing of this web D to print on a different type of web D, such as a cut form or envelope. Printing is stopped, a signal is generated manually or automatically to enable the load assist mode, and the envelope is inserted through the front, as shown in FIG. 4. Although the signal station 61 in FIG. 3 senses the continued presence of the web D, another separate signal station (not shown) may independently sense the presence of the cut form at the narrowed junction of web guides 44 and 46. Such a signal station may be integrated with the signal means 60 by one skilled in the art so that it will ignore the already present continuous web D and advance the cut form to the print station 15 in the manner previously described. The continuous web D may then be reversed to resume printing after the cut form is removed. In a still further alternate embodiment, the means for engaging and moving the web D through the print station 15 may be downstream of the print station 15. In such a configuration, referring to FIG. 2, the edge of the web D initiates the slower web advance speed as it passes the signal station 61. The web D is advanced manually through the print zone and loaded onto the pin wheels 33, or some other web advance means (not illustrated). The slower web advance mode continues until a predetermined time has elapsed, until the edge of the web D has reached another signal station downstream of the pin wheels 33, or until it is manually or otherwise stopped. Thereafter, the printer operates at its first web advance speed for normal operation.

In the drawings and specification, there have been set forth several embodiments of the invention, and although specific terms are employed, they are used in a generic and descriptive sense only and not for the purposes of limitation.

That which is claimed is:

1. A printer for use with data processing apparatus comprising:

means for recording information on a web, the means for recording information including a platen attached to the printer and a print head for generating characters, the print head being disposed in a predetermined spaced relationship from the platen to define a print station therebetween;

means for engaging and moving the web through the print station;

signal means for generating a normal mode signal and a load assist mode signal; and means for driving the means for engaging and moving the web, the means for driving being responsive to the normal mode signal from said signal means for operating at a normal rate during normal printing operation, and being responsive to the load assist mode signal from said signal means by operating at a slower than normal rate to facilitate alignment and engagement of the web with the means for engaging and moving the web during web loading operations.

2. The printer of claim 1 wherein the signal means includes a signal station, and the signal means, responding to the presence or absence of a web at the signal station, generates a normal mode signal when a web is present at the signal station and is enabled to generate a load assist mode signal when a web is absent at the signal station.

3. The printer of claim 1 wherein the means for driving operates at a constant rate in the load assist mode.

4. The printer of claim 1 wherein the signal means includes a signal station, and the signal means responds to the presentation of an edge of a web at the signal station by changing from a load assist mode signal to a normal mode signal.

5. The printer of claim 1 wherein the means for driving responds to a transition from a load assist mode signal to a normal mode signal by advancing the means for engaging and moving the web a predetermined distance so that the leading edge of the web is advanced to and then stopped at a predetermined location.

6. The printer of claim 1 wherein the signal means is responsive to a manual input.

7. The printer of claim 1 wherein said means for driving includes a stepper motor responsive to electrical pulses from a controller, the controller being responsive to the normal mode signal from the signal means for generating pulses for the stepper motor for normal printing operation and the load assist mode signal from the signal means for generating pulses for the stepper motor for constant speed, slower than normal operation.

8. The printer of claim 1 wherein the signal means responds to a manual input by, sequentially, providing a load assist mode signal for slower than normal rate of operation, and by maintaining the load assist mode signal and the slower than normal rate of operation at least until detection of the leading edge of a web at a predetermined location.

9. The printer of claim 8 wherein the signal means responds to a manual input and a signal reflecting the absence of a web in the printer.

10. The printer of claim 1 wherein the means for engaging and moving the web comprises movable means having protruding pins for engaging corresponding perforations in the web.

11. The printer of claim 1 wherein the means for engaging and moving the web comprises friction roll means having at least one driven roll and at least one opposing pressure roll forming a nip therebetween to frictionally engage and move the web.

12. The printer of claim 1 wherein the means for engaging and moving the web comprises movable means having protruding pins for engaging corresponding perforations in the web, and friction roll means having at least one driven roll and at least one opposing pressure roll forming a nip therebetween to frictionally engage and move the web.

13. The printer of claim 1 wherein the means for engaging and moving the web is disposed upstream of the print station to advance the leading edge of the web to a first predetermined location in the print station.

14. The printer of claim 1 wherein the printer further includes a plurality of web feeding guide path means to accommodate and feed a plurality of webs through the print station, wherein said signal means further generates a signal responsive to the presence or absence of a web in at least one of the web feeding guide path means.

15. A printer as in claim 14 wherein the signal means generates a signal responsive to the presence or absence of a web in each of the web feeding guide path means.

16. The printer of claim 14 wherein the means for driving responds to a transition from a load assist mode signal to a normal mode signal arising from the presentation of a web to any one of the web feeding guide path means by advancing the means for engaging and moving the web a predetermined distance so that the leading edge of the presented web is advanced to and then stopped at a predetermined location.

17. A printer for use with data processing apparatus comprising:

means for recording information on a web, the means for recording information including a platen attached to the printer and a print head for generating characters, the print head being disposed in a predetermined spaced relationship from the platen to define a print station therebetween;

means for engaging and moving the web through the print station;

signal means for generating a normal mode signal and load assist mode signal, said signal means including a signal station that responds to the presence or absence of a web at the signal station and further including a manual input means, said signal means generating a load assist mode signal in response to the absence of a web and a manual input; and means for driving the means for engaging and moving the web, the means for driving being responsive to the normal mode signal from said signal means for operating at a normal rate during normal printing operation, and being responsive to the load assist mode signal from said signal means by operating at a slower than normal rate to facilitate alignment and engagement of the web with the means for engaging and moving the web during web loading operations.

18. A printer as in claim 17 wherein the signal means responds to the presentation of an edge of a web at the signal station by changing from a load assist mode signal to a normal mode signal.

19. The printer of claim 17 wherein the means for driving responds to a transition from a load assist mode signal to a normal mode signal by advancing the means for engaging and moving the web a predetermined distance so that the leading edge of the web is advanced to and then stopped at a predetermined location.

20. The printer of claim 17 wherein the means for driving operates at a constant rate in the load assist mode.

21. The printer of claim 17 wherein said means for driving includes a stepper motor responsive to electrical pulses from a controller, the controller being responsive to the normal mode signal from the signal means for generating pulses for the stepper motor for normal printing operation and the load assist mode signal from the signal means for generating pulses for the stepper motor for constant speed, slower than normal operation.

22. A method for loading a web into a printer for use with data processing apparatus, the printer having a normal mode of operation for moving the web at a normal rate in normal printing and a load assist mode of operation for loading the web into the printer, the method of loading the printer comprising:

enabling the load assist mode of operation;

initiating a slower than normal rate of operation of the means on the printer for engaging and moving the web through a web guide path means;

loading the web onto the means on the printer for engaging and moving the web;

sensing, at a sensor station along the web guide path means, a leading edge of the web;

generating a signal in response to the sensing of the leading edge of the web at the sensor station;

continuing to advance the sensed leading edge of the web for a predetermined distance after generation of the first signal; and enabling the normal mode of operation for succeeding web advance operations.

23. The method of claim 22 wherein the step of initiating a slower than normal rate of operation comprises manually inputting a signal to the printer.

24. The method of claim 22 wherein the step of initiating a slower than normal rate of operation comprises detecting the edge of a web at a signal station and generating a second signal for initiating the slower than normal rate.

25. The method of claim 22 wherein the step of loading the web comprises driving the means on the printer for engaging and moving the web at a slower than normal rate and manually presenting and loading the web onto the means for engaging and moving the web.

26. The method of claim 22 wherein the step of initiating a slower than normal rate of operation comprises operating the means on the printer for engaging and moving the web at a constant and slower than normal rate of operation.

* * * * *